US008152495B2

(12) United States Patent
Boggess, Jr. et al.

(10) Patent No.: US 8,152,495 B2
(45) Date of Patent: Apr. 10, 2012

(54) PERIPHERAL DISCHARGE TUBE AXIAL FAN

(75) Inventors: Andrew Lacey Boggess, Jr., Shokan, NY (US); Gennady M. Levin, Guilderland, NY (US)

(73) Assignee: Ametek, Inc., Paoli, PA (US)

( * ) Notice: Subject to any disclaimer, the term of this patent is extended or adjusted under 35 U.S.C. 154(b) by 758 days.

(21) Appl. No.: 12/243,353

(22) Filed: Oct. 1, 2008

(65) Prior Publication Data

US 2010/0080719 A1 Apr. 1, 2010

(51) Int. Cl.
*F04D 25/06* (2006.01)
*F04D 29/34* (2006.01)

(52) U.S. Cl. ..... 417/423.14; 417/423.8; 416/210 R; 416/223 R; 416/189; 415/221; 415/220; 415/206

(58) Field of Classification Search ..... 417/423.14, 417/424.1, 423.8; 415/206, 220
See application file for complete search history.

(56) References Cited

U.S. PATENT DOCUMENTS 4,364,712 A * 12/1982 Charles ..... 416/183
5,407,324 A * 4/1995 Starnes et al. ..... 415/208.5
5,707,205 A * 1/1998 Otsuka ..... 415/119
5,730,583 A * 3/1998 Alizadeh ..... 416/189
5,895,206 A 4/1999 Chuang et al. ..... 416/189
6,293,753 B1 9/2001 Pal et al. ..... 415/221
6,447,251 B1 * 9/2002 Zeng ..... 416/210 R
6,457,955 B1 * 10/2002 Cheng ..... 417/423.8
6,468,150 B1 * 10/2002 Langdon et al. ..... 454/184
6,902,377 B2 * 6/2005 Crocker ..... 416/223 R
7,031,157 B2 4/2006 Horng et al. ..... 361/695
7,080,970 B2 7/2006 Horng et al. ..... 415/213.1
7,223,068 B2 5/2007 Horng et al. ..... 415/187
2007/0071618 A1 * 3/2007 Rhoads ..... 417/423.1
2007/0194668 A1 * 8/2007 Teshima et al. ..... 310/67 R

* cited by examiner

*Primary Examiner* — Sikha Roy
(74) *Attorney, Agent, or Firm* — Renner Kenner Greive Bobak Taylor & Weber

(57) ABSTRACT

A mixed flow fan assembly includes an electric motor, an impeller having a hub enclosing the motor, and a plurality of fan blades spaced circumferentially around the hub. The fan assembly also includes an axis of rotation extending through the hub, an annular venturi radially surrounding the impeller, and a mounting plate with an opening to allow for axial airflow positioned on one open end of the venturi. The venturi has at least one elongated slot to allow for radial airflow from the fan assembly, the slot being oriented substantially perpendicular to the axis of rotation and having a generally rectangular shape. Rotation of the hub and the fan blades caused by the electric motor generates both axial and radial airflow through the fan assembly.

17 Claims, 6 Drawing Sheets

PERIPHERAL DISCHARGE TUBE AXIAL FAN

TECHNICAL FIELD

One or more embodiments of the present invention relate to a cooling fan assembly for use in electronic devices. Specifically, one or more embodiments of the present invention relate to a cooling fan assembly adapted to generate both axial and radial airflow.

BACKGROUND ART

A wide variety of electronic devices and systems employ cooling fans in their housings. The cooling fans generate air flow through the housing and across or over heat generating components to prevent overheating and to protect the heat generating components from damage resulting from extreme temperatures. Devices that conventionally use cooling fans include, for example, portable and desktop computers, radios, automobiles, industrial equipment, and communication system infrastructure. Cooling fans typically come in one of two forms: tube axial fans and motorized impeller fans, otherwise known as centrifugal flow fans.

Tube axial fans have blades that force air to move parallel to the shaft about which the blades rotate. Fan blades are typically mounted around a hub that encloses an electric motor. The hub and fan blades, or impeller, are mounted within a shroud that is cylindrical in shape. Tube axial fans are known for high air flows and relatively low operating pressures, and can have an efficiency as high as 65%. At higher pressures, such as in compact electrical devices where components may block axial airflow, tube axial fans decrease in efficiency and are prone to overloading.

Centrifugal flow fans have blades that force air to move in a radial direction relative to the shaft about which the blades rotate. The centrifugal fan blades are also mounted about a hub and can be airfoil blades, straight blades, backward curved blades, backward inclined blades, radial tip blades, forward curved blades, and radial blades. Each blade type results in different performance characteristics of the centrifugal fan. While centrifugal fans can operate at high pressures and can avoid over-loading, they do not provide the high flow rate that axial tube fans can provide.

In many modern devices, size is a significant concern. Electronics such as computers are becoming increasingly compact. The high density of heat generating electronics within these devices and the lack of space for air flow can create unique cooling demands. A cooling fan is needed that can provide high flow rates while also operating efficiently at increased pressures caused by obstructed flow paths.

SUMMARY OF THE INVENTION

In light of the foregoing, it is a first aspect of the present invention to provide a peripheral discharge tube axial fan.

It is another aspect of the present invention to provide a cooling fan assembly comprising a hub carrying an electric motor, the hub having an axis of rotation extending therethrough, a plurality of fan blades spaced circumferentially around the hub, an annular venturi radially surrounding the fan blades, and at least one slot in the venturi to allow air to flow radially through the venturi, wherein rotation of the fan blades caused by the electric motor generates axial airflow through the annular venturi and radial airflow through the at least one slot, and wherein the radial airflow increases as the axial airflow decreases to provide a substantially consistent flow of cooling air.

It is still another aspect of the present invention to provide a cooling fan assembly comprising an impeller including an electric motor, a hub enclosing the electric motor, and a plurality of fan blades spaced circumferentially around the hub, an annular venturi radially surrounding the impeller, a mounting plate positioned on one open end of the venturi, and the venturi having a plurality of elongated slots that are oriented to extend circumferentially around the venturi and are located proximal to the mounting plate.

It is yet another aspect of the present invention to provide a cooling fan assembly comprising an electric motor, an impeller having a hub enclosing the electric motor and a plurality of fan blades spaced circumferentially around the hub, an axis of rotation extending through the hub, an annular venturi having an open end and radially surrounding the impeller, a mounting plate positioned on one side of the venturi and having an opening therein aligned with the open end to allow for axial airflow through the fan assembly, and at least one elongated slot in the venturi to allow for radial airflow from the fan assembly, the slot being oriented substantially perpendicular to the axis of rotation and having a generally rectangular shape, wherein the fan blades each include a leading edge positioned adjacent to a side of the venturi opposite of the mounting plate, and a trailing edge positioned adjacent to the mounting plate, and wherein rotation of the hub and the fan blades caused by the electric motor generates both axial and radial airflow through the fan assembly.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
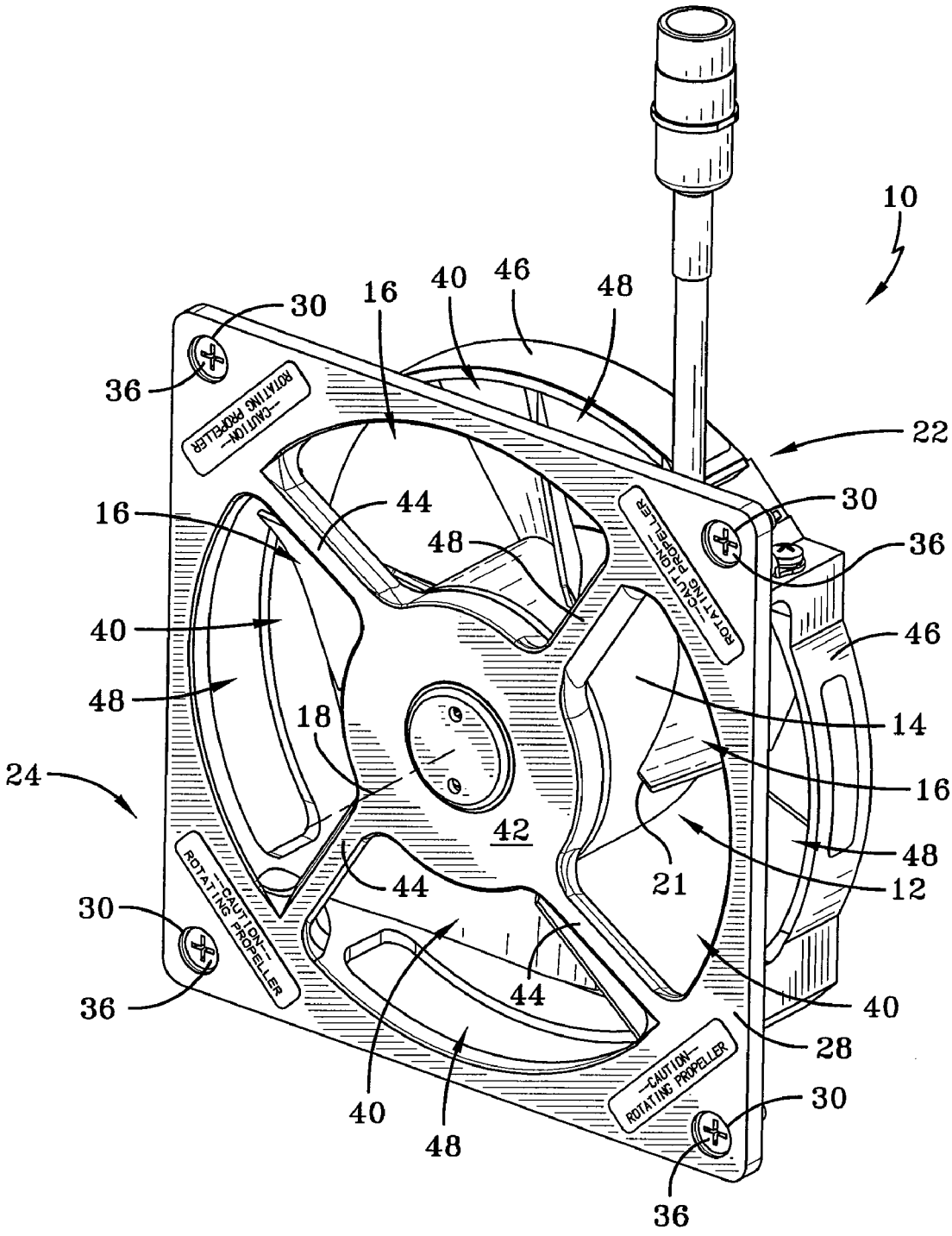
FIG. 1 is a perspective view of a fan assembly according to the concepts of the present invention showing the front side of the assembly.
Figure 2:
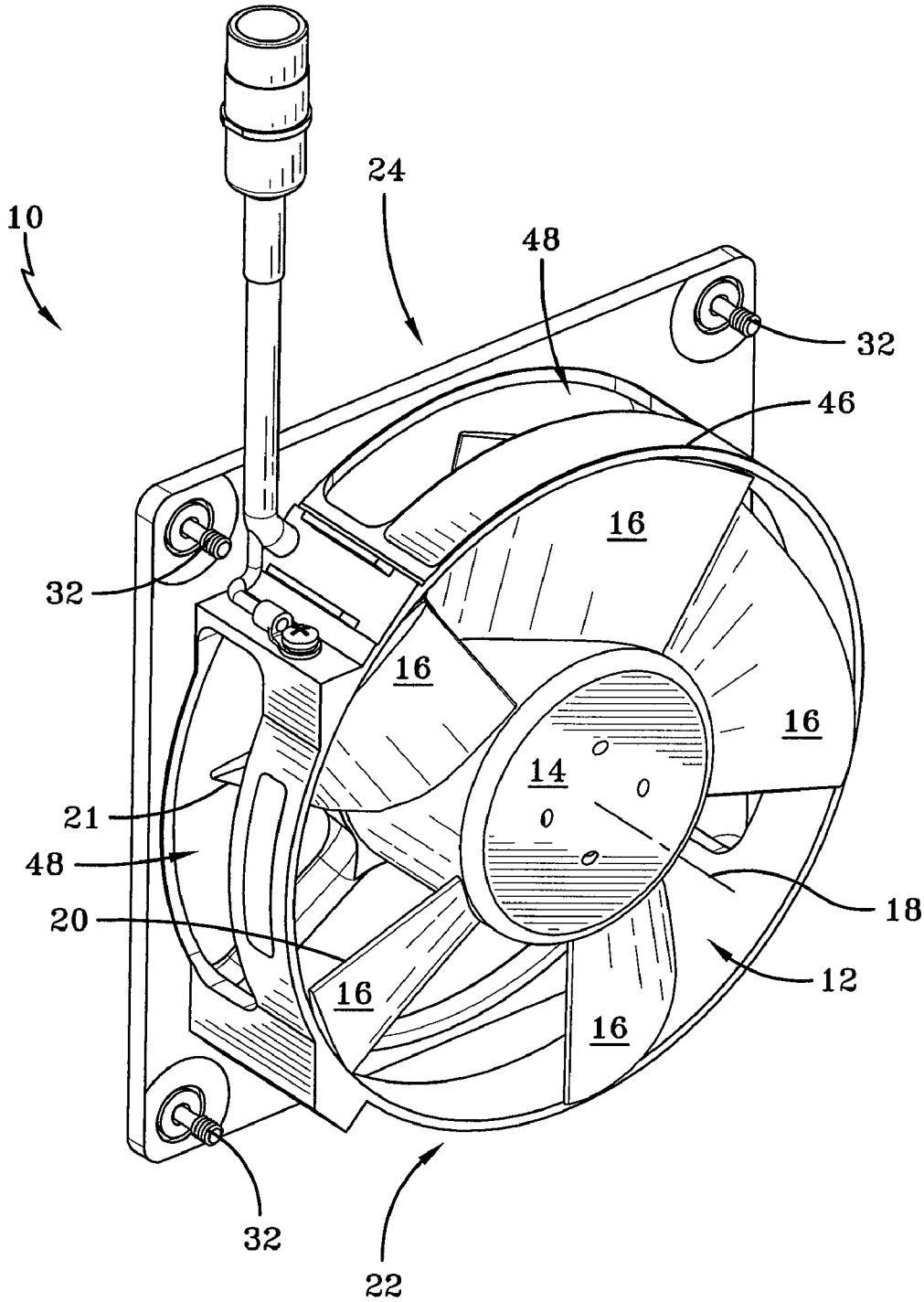
FIG. 2 is a perspective view showing the back side of the fan assembly of the present invention.
Figure 3:
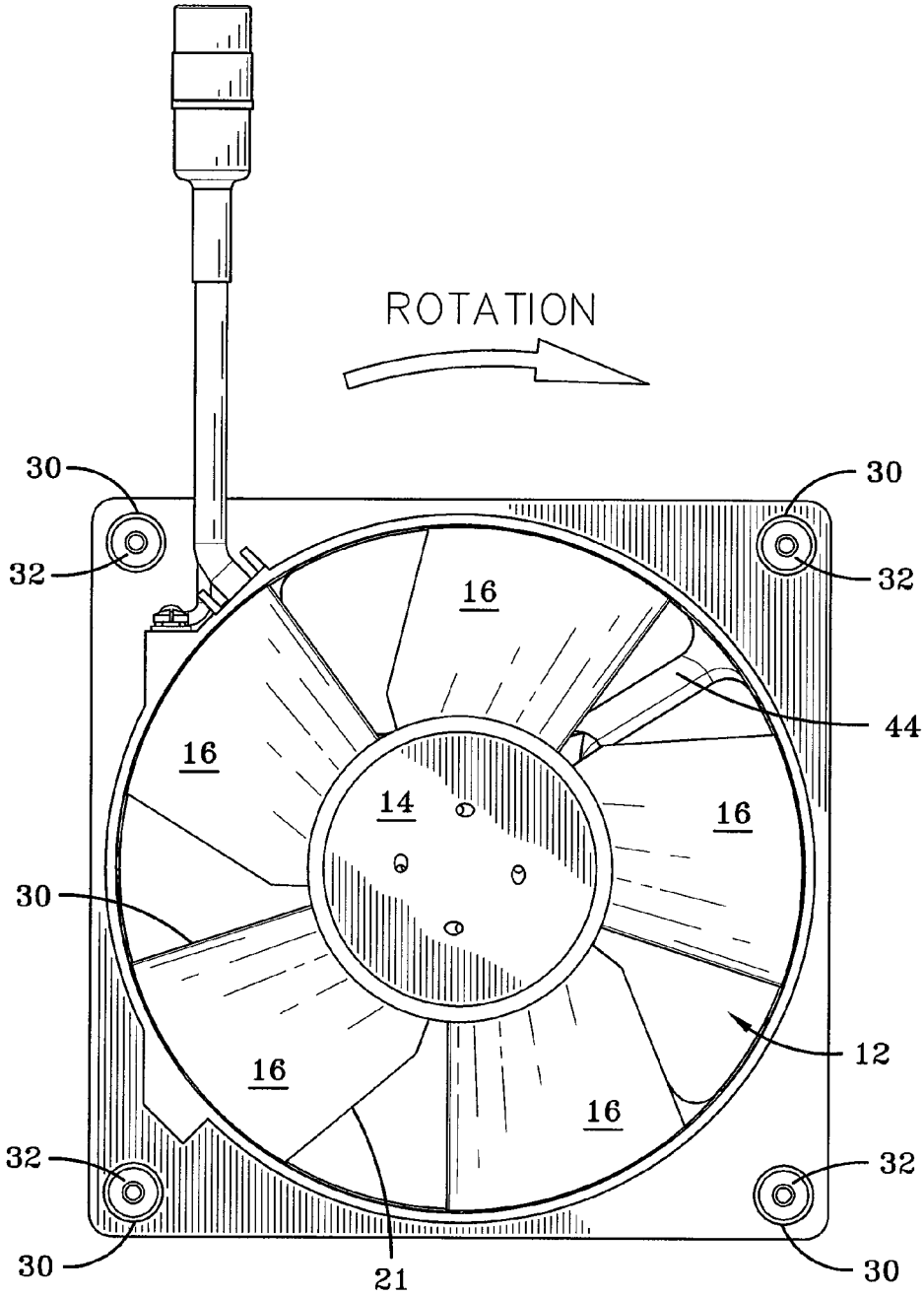
FIG. 3 is a back view of the fan assembly of the current invention.
Figure 4:
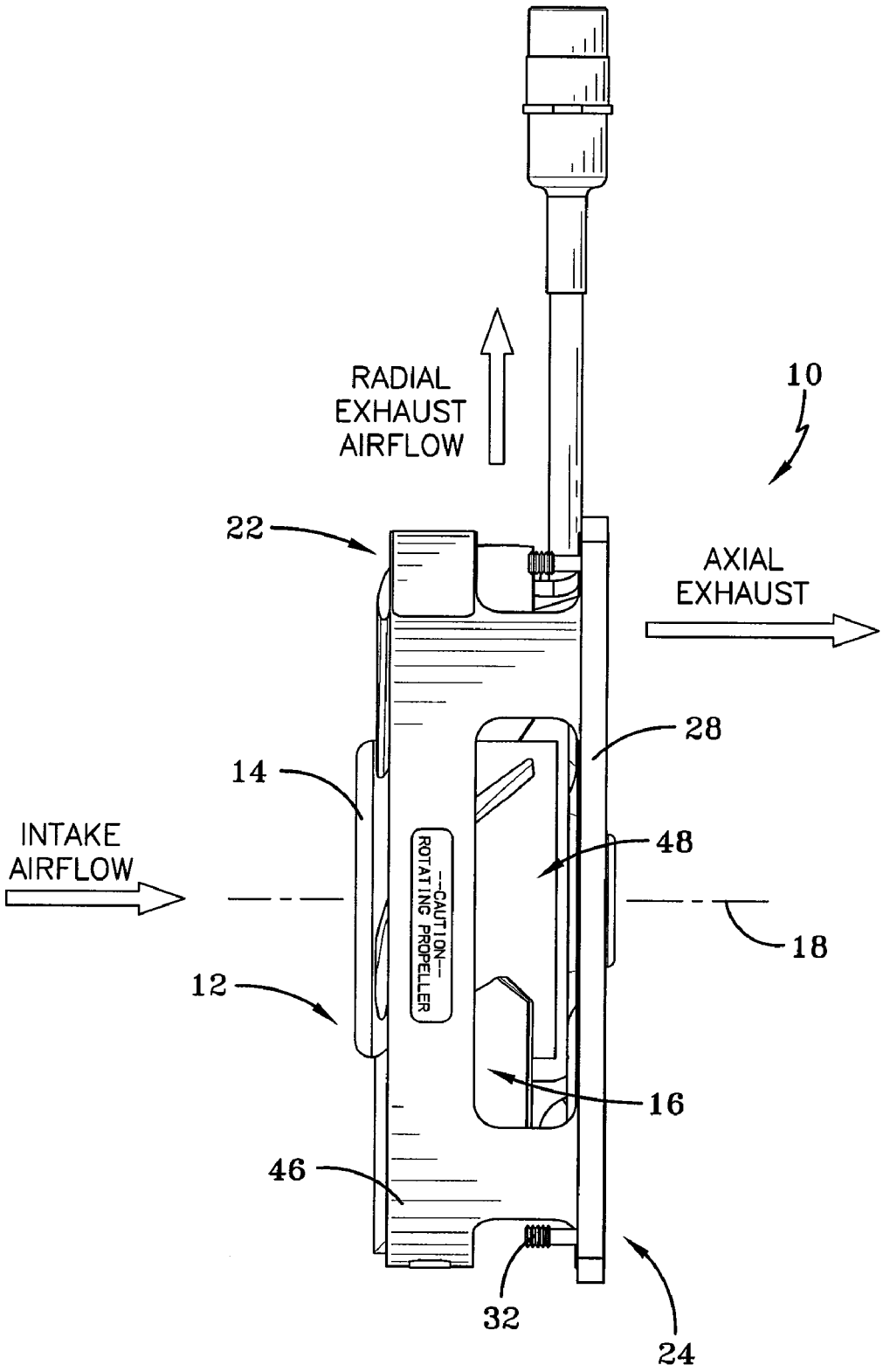
FIG. 4 is a side view of the fan assembly of the present invention showing a radial airflow slot.
Figure 5:
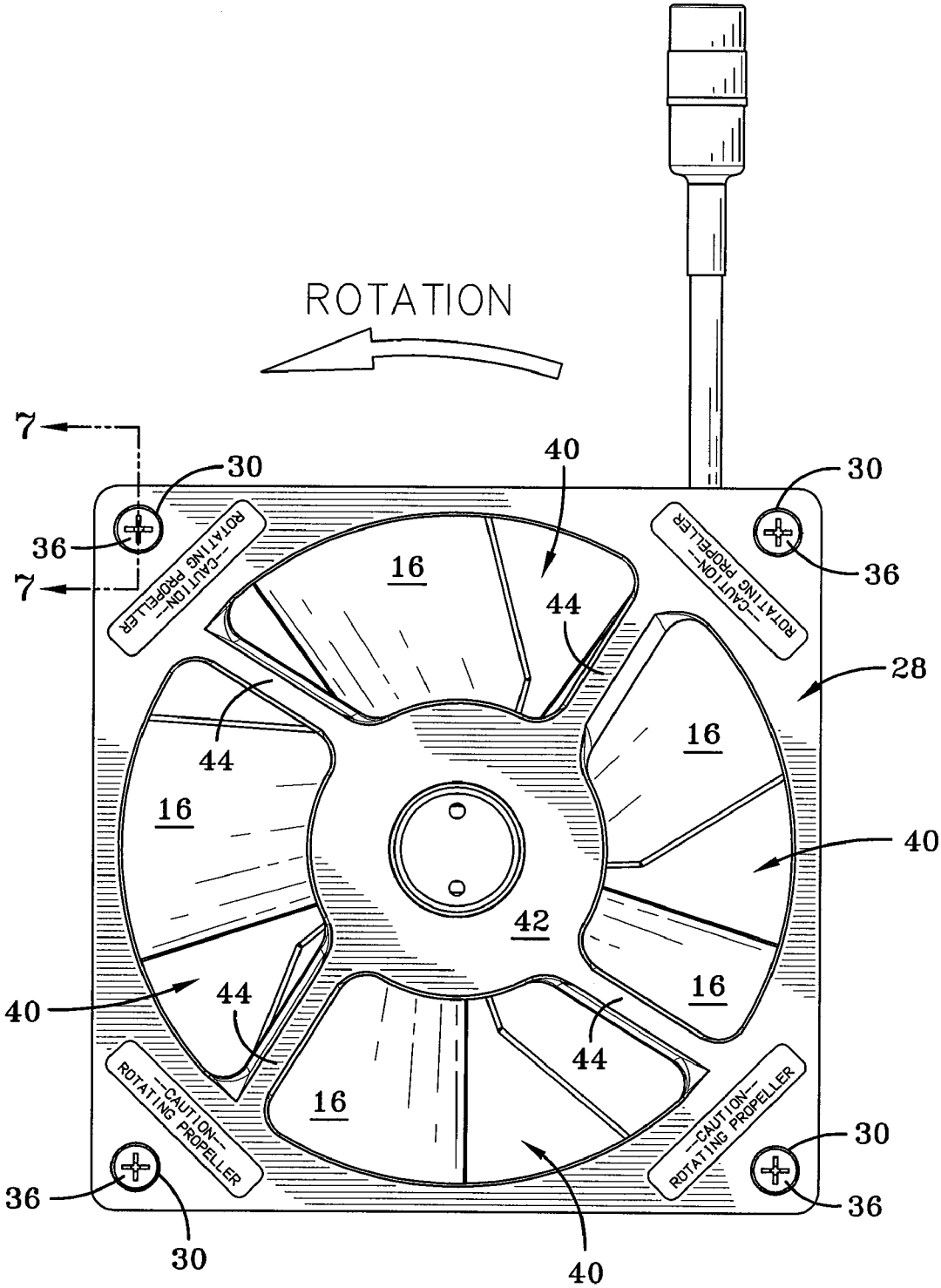
FIG. 5 is a front view of the fan assembly of the present invention.

An exemplary fan assembly according to the concepts of the present invention is generally indicated by the numeral 10 in the drawings. Fan assembly 10 may be installed in an electronic device as a cooling fan, and may be strategically placed in order to maximize airflow across specific heat-generating components, or heat sinks, within the device. The assembly may be installed and positioned so as to draw cooling air into the device, or may be installed and positioned to exhaust hot air from the device. Some devices may utilize multiple fan assemblies to both draw cooling air into the device and exhaust hot air from the device.

Fan assembly 10 includes an impeller 12 having a hub 14 at its center and a plurality of fan blades 16 spaced circumferentially around and extending radially from hub 14. Hub 14 is generally cylindrical in shape, and encloses an electric motor (not shown) therein, as is well known in the art. The electric motor may be either a DC motor or an AC motor, depending upon the device in which the fan assembly 10 is to be installed and the operating conditions of that device. Hub 14 rotates about an axis of rotation 18 extending through the center thereof. One or more ball bearings may be provided within hub 14, as is known in the art, to improve the reliability of impeller 12 and to increase the life span of fan assembly 10. Impeller 12, including both hub 14 and fan blades 16, may be made from any desired material known to persons having ordinary skill in the art. One such material, for example, may be aluminum, which may be advantageous due to its high strength and low weight characteristics. While five fan blades 16 are shown in the drawings around hub 14, it should be appreciated that more or less fan blades may be provided without deviating from the scope of the present invention.

Fan blades 16 each include a leading edge 20 and a trailing edge 21. Leading edge 20 of each fan blade 16 is positioned axially adjacent to an inlet side 22 of fan assembly 10, and trailing edge 21 of fan blades 16 is positioned axially adjacent to an outlet side 24 of fan assembly 10. Fan blades 16 may each be curved both axially, along the length of hub 14 from the inlet side 22 to the outlet side 24, as well as radially from a larger leading edge 20 to a smaller trailing edge 21. This fan blade geometry assists in drawing air into fan assembly 10 at inlet side 22 and forcing the same air out of fan assembly 10 at outlet side 24, or radially as will be discussed in greater detail below. Other fan blade shapes may also be used, as will be appreciated by those skilled in the art.

Figure 7:
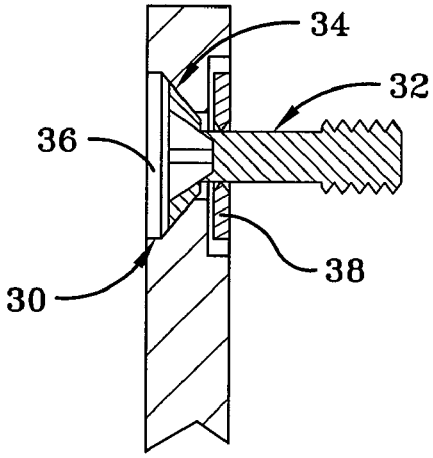
FIG. 7 is a cross-section of a fan assembly fastener as indicated in FIG. 5.

Fan assembly 10 may be provided with a mounting plate 28 to facilitate securing the fan within a device housing. Mounting plate 28, while shown in the drawings as being located on outlet side 24 of fan assembly 10, may also be located on inlet side 22 in alternative embodiments. Mounting plate 28 is rectangular in shape, although it may alternatively be provided in other shapes, and includes apertures 30 in each corner. Fasteners 32 are disposed within apertures 30 to secure mounting plate 28 in a desired location within an electronic device. As best seen in FIG. 7, apertures 30 may optionally include a tapered recess 34 to accommodate a head 36 on fasteners 32, thereby allowing heads 36 of fasteners 32 to be flush with mounting plate 28. A washer 38 may also be provided on the inlet side of mounting plate 28 around fastener 32. A portion of fastener 32 is threaded and is adapted to be received by a threaded hole within the housing.

Mounting plate 28 includes a plurality of openings 40 therethrough to allow for axial airflow through fan assembly 10. In the embodiment of the fan assembly 10 shown in the drawings four openings 40 are provided, spaced about a center portion 42 of mounting plate 28. Hub 14 is secured to center portion 42 so that axis of rotation 18 that extends through the center of hub 14 also extends through the approximate center of center portion 42. A number of ribs 44 act to connect center portion 42 of mounting plate 28 with the outer portion of the mounting plate 28, while also acting to separate the four openings 40. Openings 40, together, form a generally disc shaped opening, interrupted by ribs 44. The inner periphery of the disc shaped opening and the outer surface of hub 14 are substantially radially aligned. Openings 40 may be provided with beveled and rounded edges to improve airflow therethrough, thereby increasing the efficiency of fan assembly 10. While the structural configuration of openings 40, center portion 42 and ribs 44 are believed to optimize the axial airflow through fan assembly 10 while maintaining the necessary strength of mounting plate 28, other configurations may be employed to provide an opening in the mounting plate.

A venturi 46, also sometimes called a shroud, is an annular wall that radially surrounds and encloses impeller 12. Venturi 46 extends axially from mounting plate 28 in the same direction as impeller 12 such that it substantially encloses fan blades 16. Venturi 46 is cylindrical in shape, and is sized to have an inner radius approximately equal to but slightly larger than the largest radius of fan blades 16 so that impeller 12 can rotate freely within venturi 46. Openings 40 are positioned on mounting plate 28 so that air channeled within venturi 46 can pass through the openings when impeller 12 is activated. In the fan assembly 10 shown in the drawings, openings 40 are positioned radially between center portion 42 and venturi 46, with the outer periphery of the disc shaped opening and the inner surface of venturi 46 are substantially radially aligned.

Figure 6:
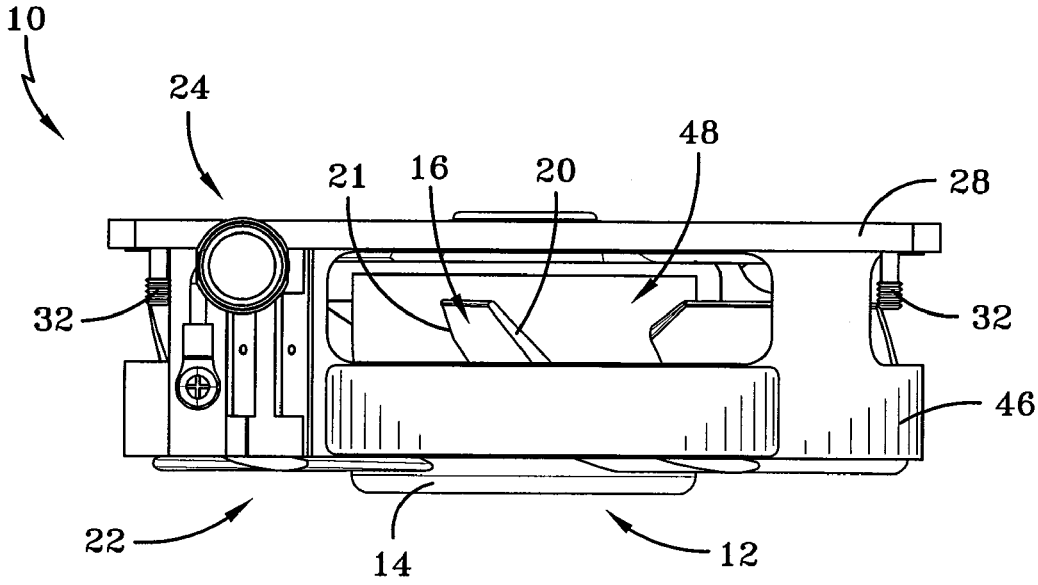
FIG. 6 is a top view of the fan assembly showing a radial airflow slot.

Venturi 46 includes slots 48 to allow air drawn in by impeller 12 to be expelled radially from fan assembly 10. Slots 48 are generally rectangular in shape, and extend circumferentially around venturi 46. Four slots 48 are shown, although more or less may be provided within the scope of the present invention. Slots 48 may be positioned axially adjacent to the outlet side of venturi 46 to improve fan assembly efficiency. The width of each slot 48 is between approximately 0.25 and 0.75 times the width of the venturi 46. Slots 48 may have a circumferential opening or length ranging anywhere from about 20° to about 70°. It will further be appreciated that the length of the slot's circumferential opening is greater than the width or depth of the opening. And, as can best be seen in FIG. 6, the trailing edge 21 of fan blades 16 are substantially medially positioned with respect to the width of the slot 48. As air is drawn into fan assembly 10 by impeller 12, the air is forced axially from inlet side 22 to outlet side 24, while simultaneously being forced radially toward venturi 46. Thus, by locating slots 48 adjacent to the outlet side of venturi 46, air is allowed flow radially more easily.

Fan assembly 10 may optionally be secured within an outward protrusion of the device housing in which it is installed. Such a protrusion may be sized approximately equal to the size of mounting plate 28, and may include multiple mesh covered or screened openings to improve airflow into or out of the device. For example, a rectangular protrusion approximately the same size as fan assembly 10, but slightly larger, may have a mesh screen on its outward axial end, as well as mesh covered openings on its top, bottom, and sides. This arrangement allows air from fan assembly 10 to be expelled from the device housing in both the axial and radial directions, and takes advantage of the dual airflow of the fan assembly 10.

Fan assembly 10 allows for both axial and radial airflow due to the presence of slots 48 in venturi 46. Because slots 48 act to reduce pressures within venturi 46, fan assembly 10 can operate at higher pressures while avoiding overloading. Fan assembly 10 also provides increased airflow as compared to conventional centrifugal fans because it allows for both axial and radial airflow. The structure, sizing and placement of openings 40 and slots 48 interact to provide increased efficiency for fan assembly 10. In addition, the presence of dual airflows allows fan assembly 10 to adapt to working conditions by a naturally varying percentage of radial flow versus axial flow through fan assembly 10 dictated by the operating pressures. As pressure increases, the percentage of radial airflow through fan assembly 10 increases, and as pressure decreases the percentage of axial airflow through fan assembly 10 increases.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto and thereby. Accordingly, for an appreciation of the true scope and breadth of the invention, reference should be made to the following claims.

What is claimed is:

1. A cooling fan assembly comprising:

a hub carrying an electric motor, said hub having an axis of rotation extending therethrough;

a plurality of fan blades spaced circumferentially around said hub;

an annular venturi radially surrounding said fan blades; and said venturi having at least one opening to allow air to flow radially out through said at least one opening, wherein said at least one opening is positioned substantially perpendicular to said axis of rotation and axially adjacent to an outlet side of said venturi such that said at least one opening extends primarily circumferentially around said venturi and in a direction longitudinal with a plane of rotation of said plurality of fan blades, wherein each said fan blade has a leading edge and a trailing edge substantially medially positioned with respect to a width of said opening wherein rotation of said fan blades caused by said electric motor generates axial airflow through said annular venturi and radial airflow through said at least one opening, and wherein the radial airflow increases as the axial airflow decreases to provide a substantially consistent flow of cooling air.

2. The cooling fan assembly of claim 1, wherein said at least one opening is a slot in said venturi that is generally rectangular in shape.

3. The cooling fan assembly of claim 2, wherein said at least one slot has a circumferential length greater than an axial width.

4. The cooling fan assembly of claim 1, further comprising:

a mounting plate positioned on one axial end of said venturi and said hub to facilitate mounting of the fan assembly within a device housing.

5. The cooling fan assembly of claim 4, wherein said mounting plate is rectangular in shape and includes apertures adapted to receive mounting screws.

6. The cooling fan assembly of claim 4, wherein said mounting plate includes a plate opening adapted to allow air to flow axially through said fan assembly.

7. The cooling fan assembly of claim 4, wherein said at least one opening in said venturi is positioned adjacent to said mounting plate.

8. The cooling fan assembly of claim 7, wherein said venturi includes four slots spaced circumferentially around said plurality of fan blades.

9. The cooling fan assembly of claim 4, wherein said fan blades each includes said trailing edge positioned axially opposite said mounting plate and said trailing edge positioned proximate to said mounting plate in the axial direction.

10. A cooling fan assembly comprising:

an impeller including an electric motor, a hub enclosing said electric motor, and a plurality of fan blades spaced circumferentially around said hub;

an annular venturi radially surrounding said impeller;

a mounting plate positioned on one open end of said venturi; and said venturi having a plurality of elongated openings that are located proximal to said mounting plate, said plurality of elongated openings extend lengthwise circumferentially around said venturi and said plurality of fan blades so that air flows outwardly from said plurality of elongated openings when said impeller rotates, and wherein each said fan blade includes a leading edge positioned axially adjacent to a side of said venturi opposite of said mounting plate, and a trailing edge positioned axially adjacent to said mounting plate and juxtaposed adjacent said plurality of elongated openings.

11. The cooling fan assembly of claim 10, wherein said openings are slots which are generally rectangular in shape, have a length and a width, said length being larger than said width.

12. The cooling fan assembly of claim 11, wherein said venturi has a width, and wherein the width of said slots is between approximately 0.25 and 0.75 times the width of said venturi.

13. The cooling fan assembly of claim 11, wherein said assembly includes four slots in said venturi to allow radial airflow from said assembly.

14. The cooling fan assembly of claim 10, wherein said mounting plate is rectangular in shape and larger than said venturi, thereby providing a plurality of exposed corners to facilitate mounting of the fan assembly.

15. The cooling fan assembly of claim 10, wherein said mounting plate includes a plate opening to allow axial airflow therethrough.

16. The cooling fan assembly of claim 10, wherein said electric motor is secured to said mounting plate and said hub is secured to said electric motor.

17. A cooling fan assembly comprising:

an electric motor;

an impeller having a hub enclosing said electric motor and a plurality of fan blades spaced circumferentially around said hub;

an axis of rotation extending through said hub;

an annular venturi having an open end and radially surrounding said impeller;

a mounting plate positioned on one side of said venturi and having a plate opening therein aligned with said open end to allow for axial airflow out through the fan assembly; and said venturi having a venturi opening to allow for radial airflow out from the fan assembly, said venturi opening being oriented substantially perpendicular to said axis of rotation and having a generally rectangular shape, wherein said fan blades each include a leading edge positioned adjacent to a side of said venturi opposite of said mounting plate, and a trailing edge positioned adjacent to said mounting plate and juxtaposed adjacent said venturi opening, and wherein rotation of said hub and said fan blades caused by said electric motor generates both axial and radial airflow through the fan assembly.

* * * * *